US010145219B2

(12) United States Patent
Bourgneuf et al.

(10) Patent No.: US 10,145,219 B2
(45) Date of Patent: Dec. 4, 2018

(54) COMPLETION SYSTEM FOR GRAVEL PACKING WITH ZONAL ISOLATION

(71) Applicant: Halliburton Energy Services, Inc., Houston, TX (US)

(72) Inventors: Patrick Patchi Bourgneuf, Pau (FR); Andrew David Penno, Porcheres (FR); Maxime Philippe Coffin, Frisco, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 171 days.

(21) Appl. No.: 15/106,096

(22) PCT Filed: Jun. 5, 2015

(86) PCT No.: PCT/US2015/034555

§ 371 (c)(1),
(2) Date: Jun. 17, 2016

(87) PCT Pub. No.: WO2016/195720

PCT Pub. Date: Dec. 8, 2016

(65) Prior Publication Data

US 2017/0138158 A1 May 18, 2017

(51) Int. Cl.
*E21B 43/04* (2006.01)
*E21B 33/12* (2006.01)
(Continued)

(52) U.S. Cl.
CPC ..... *E21B 43/04* (2013.01); *E21B 33/12* (2013.01); *E21B 33/127* (2013.01); *E21B 34/06* (2013.01);
(Continued)

(58) Field of Classification Search
CPC ..... E21B 17/18; E21B 33/127; E21B 33/122; E21B 33/1243; E21B 43/04; E21B 43/08; E21B 43/14
See application file for complete search history.

(56) References Cited

U.S. PATENT DOCUMENTS 3,412,805 A * 11/1968 Gribbin ..... E21B 33/1243 166/147
4,270,608 A * 6/1981 Hendrickson ..... E21B 23/006 166/127
(Continued)

FOREIGN PATENT DOCUMENTS

WO WO-2016195720 A1 * 12/2016 ..... E21B 33/12

OTHER PUBLICATIONS

International Search Report and Written Opinion dated Mar. 2, 2016; International PCT Application No. PCT/US2015/034555.

*Primary Examiner* — Jennifer H Gay
(74) *Attorney, Agent, or Firm* — McGuireWoods LLP

(57) ABSTRACT

A wellbore completion system includes a tubular positioned in the wellbore such that an annulus is created between the tubular and a portion of the wellbore. The system further includes a gravel pack packer, a first packer positioned downhole of the gravel pack packer, and a second packer positioned downhole of the first packer. The gravel pack packer and the first packer define a first zone in the annulus, and the first and second packers define a second zone in the annulus. A wash pipe is positioned within the tubular and is positionable in a first position to allow fluid communication between a first port and the first packer and a second port and the second packer. The wash pipe is positionable in a second position to allow fluid communication between the first port and the first zone and the second port and the second zone.

20 Claims, 6 Drawing Sheets

(51) Int. Cl.

| | |
|---|---|
| ***E21B 43/08*** | (2006.01) |
| ***E21B 43/14*** | (2006.01) |
| ***E21B 34/06*** | (2006.01) |
| ***E21B 17/18*** | (2006.01) |
| ***E21B 33/127*** | (2006.01) |
| *E21B 33/122* | (2006.01) |
| *E21B 34/00* | (2006.01) |

(52) U.S. Cl.
CPC ..... *E21B 43/08* (2013.01); *E21B 43/14* (2013.01); *E21B 17/18* (2013.01); *E21B 33/122* (2013.01); *E21B 2034/005* (2013.01)

(56) References Cited

U.S. PATENT DOCUMENTS 4,858,691 A * 8/1989 Ilfrey ..... E21B 43/045 166/230
5,746,274 A * 5/1998 Voll ..... E21B 33/127 166/131
6,230,801 B1 * 5/2001 Hill, Jr. ..... E21B 43/045 166/194
6,446,729 B1 * 9/2002 Bixenman ..... E21B 33/124 166/205
6,644,404 B2 * 11/2003 Schultz ..... E21B 34/063 166/235
7,721,801 B2 * 5/2010 Mickelburgh ..... E21B 43/045 166/236
7,735,559 B2 * 6/2010 Malone ..... E21B 43/12 166/227
7,934,553 B2 * 5/2011 Malone ..... E21B 43/08 166/205
8,794,323 B2 * 8/2014 Luce ..... E21B 43/267 166/278
8,813,850 B2 * 8/2014 Geoffroy ..... E21B 43/04 166/278
2003/0070809 A1 * 4/2003 Schultz ..... E21B 34/063 166/278
2003/0079878 A1 * 5/2003 Pramann, II ..... E21B 34/10 166/278
2004/0134656 A1 * 7/2004 Richards ..... E21B 43/04 166/276
2004/0231853 A1 11/2004 Anyan et al.
2006/0037751 A1 * 2/2006 Mickelburgh ..... E21B 17/18 166/278
2006/0060352 A1 3/2006 Vidrine et al.
2008/0283252 A1 11/2008 Guignard et al.
2008/0314589 A1 * 12/2008 Guignard ..... E21B 43/04 166/278
2009/0095471 A1 * 4/2009 Guignard ..... E21B 34/14 166/278
2009/0133875 A1 * 5/2009 Tibbles ..... E21B 43/04 166/278
2009/0260835 A1 * 10/2009 Malone ..... E21B 43/04 166/387
2010/0012318 A1 * 1/2010 Luce ..... E21B 43/04 166/278
2010/0084133 A1 * 4/2010 Weirich ..... E21B 34/14 166/278
2010/0096130 A1 * 4/2010 Parlar ..... C09K 8/04 166/278
2010/0163235 A1 7/2010 Mootoo et al.
2011/0139465 A1 * 6/2011 Tibbles ..... E21B 33/124 166/387
2011/0203793 A1 * 8/2011 Tibbles ..... E21B 43/04 166/278
2012/0103606 A1 * 5/2012 van Petegem ..... E21B 33/124 166/278
2012/0199346 A1 * 8/2012 Patel ..... E21B 43/04 166/278
2013/0008652 A1 * 1/2013 Broussard ..... E21B 33/124 166/278
2013/0248179 A1 9/2013 Yeh et al.
2013/0306313 A1 * 11/2013 Geoffroy ..... E21B 43/04 166/278
2015/0027700 A1 * 1/2015 Riisem ..... E21B 43/04 166/278
2015/0041130 A1 * 2/2015 Cleveland ..... E21B 43/04 166/276
2015/0285038 A1 * 10/2015 Yeh ..... E21B 43/04 166/278
2016/0003013 A1 * 1/2016 Eliseev ..... E21B 43/14 166/278
2017/0138158 A1 * 5/2017 Bourgneuf ..... E21B 43/04

* cited by examiner

COMPLETION SYSTEM FOR GRAVEL PACKING WITH ZONAL ISOLATION

BACKGROUND

The present disclosure relates to oil and gas exploration and production, and more particularly to a completion system for use in gravel packing operations.

Wells are drilled at various depths to access and produce oil, gas, minerals, and other naturally-occurring deposits from subterranean geological formations. Hydrocarbons may be produced through a wellbore traversing the subterranean formations. Gravel packing operations are commonly performed in subterranean formations to control unconsolidated particulates. A typical gravel packing operation involves placing a filtration bed containing gravel particulates near the well bore that neighbors the zone of interest. The filtration bed acts as a sort of physical barrier to the transport of unconsolidated particulates to the well bore that could be produced with the produced fluids. One common type of gravel packing operation involves placing a sand control screen in the well bore and packing the annulus between the screen and the well bore with gravel particulates of a specific size designed to prevent the passage of formation sand. The sand control screen is generally a filter assembly used to retain the gravel placed during the gravel pack operation. In addition to the use of sand control screens, gravel packing operations may involve the use of a wide variety of sand control equipment, including liners (e.g., slotted liners, perforated liners, etc.), combinations of liners and screens, and other suitable apparatus. A wide range of sizes and screen configurations are available to suit the characteristics of the gravel particulates used. Similarly, a wide range of sizes of gravel particulates are available to suit the characteristics of the unconsolidated particulates. The resulting structure presents a barrier to migrating sand from the formation while still permitting fluid flow.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

FIG. 5 FIG. 4 illustrates a schematic and partially cut-away view of the completion system of FIG. 2 during gravel packing operations; packing operations;

DETAILED DESCRIPTION OF ILLUSTRATIVE EMBODIMENTS

Figure 1A:
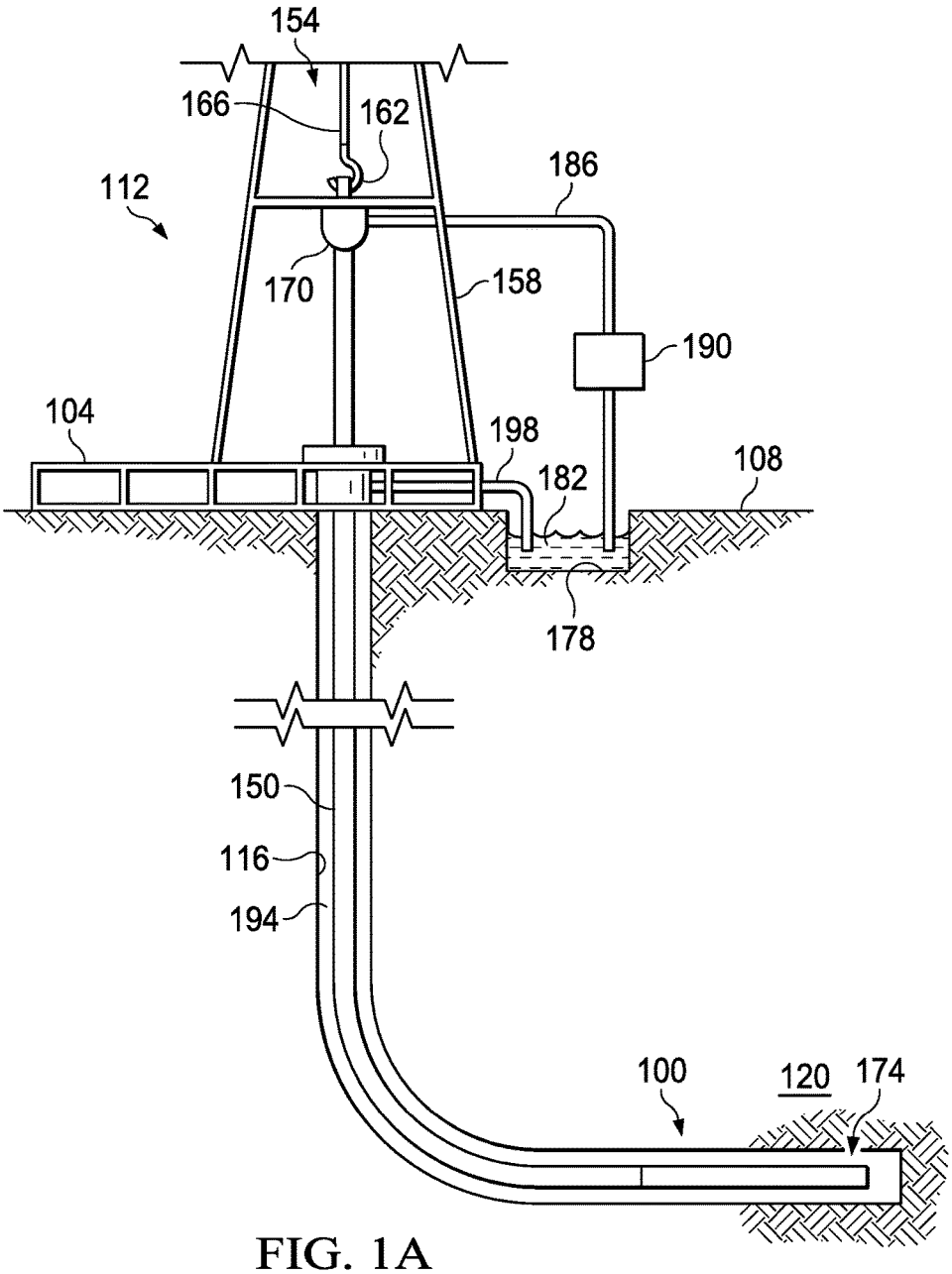
FIG. 1A illustrates a schematic view of an on-shore well having a completion system according to an illustrative embodiment.

In the following detailed description of the illustrative embodiments, reference is made to the accompanying drawings that form a part hereof. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments is defined only by the appended claims.

Unless otherwise specified, any use of any form of the terms "connect," "engage," "couple," "attach," or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to". Unless otherwise indicated, as used throughout this document, "or" does not require mutual exclusivity.

As used herein, the phrases "hydraulically coupled," "hydraulically connected," "in hydraulic communication," "fluidly coupled," "fluidly connected," and "in fluid communication" refer to a form of coupling, connection, or communication related to fluids, and the corresponding flows or pressures associated with these fluids. In some embodiments, a hydraulic coupling, connection, or communication between two components describes components that are associated in such a way that fluid pressure may be transmitted between or among the components. Reference to a fluid coupling, connection, or communication between two components describes components that are associated in such a way that a fluid can flow between or among the components. Hydraulically coupled, connected, or communicating components may include certain arrangements where fluid does not flow between the components, but fluid pressure may nonetheless be transmitted such as via a diaphragm or piston or other means of converting applied flow or pressure to mechanical or fluid force.

While a portion of a wellbore may in some instances be formed in a substantially vertical orientation, or relatively perpendicular to a surface of the well, the wellbore may in some instances be formed in a substantially horizontal orientation, or relatively parallel to the surface of the well, the wellbore may include portions that are partially vertical (or angled relative to substantially vertical) or partially horizontal (or angled relative to substantially horizontal). In some wellbores, a portion of the wellbore may extend in a downward direction away from the surface and then back up toward the surface in an "uphill," such as in a fish hook well. The orientation of the wellbore may be at any angle leading to and through the reservoir.

The present disclosure relates generally to completion systems that allow gravel packing while providing zonal isolation to create a plurality of distinct production zones or isolation zones. Some of the zones may be actively producing formation fluids, while others may be non-productive zones. The establishment of separate zones provides the ability to shut off some zones, thereby preventing production from these zones. Creating zones also allows for a smooth production profile when each zone is allowed to contribute. Furthermore, when an isolation zone is established in a non-producing portion of the formation, that particular zone may not be gravel packed to realize cost savings. While gravel packing operations may assist in controlling an unconsolidated zone, the process of establishing separate zones and gravel packing those zones may heighten the risk of partial or total collapse if the hydrostatic pressure within a particular zone is not able to be maintained. For this reason, it may be desirable to minimize any significant pressure differential between zones. The systems and methods described herein assist in providing pressure maintenance between the different zones, improve isolation between zones by providing the capability of simultaneous hydraulic actuation of the packers between the zones, and allow gravel packing after isolation has been established.

Figure 1B:
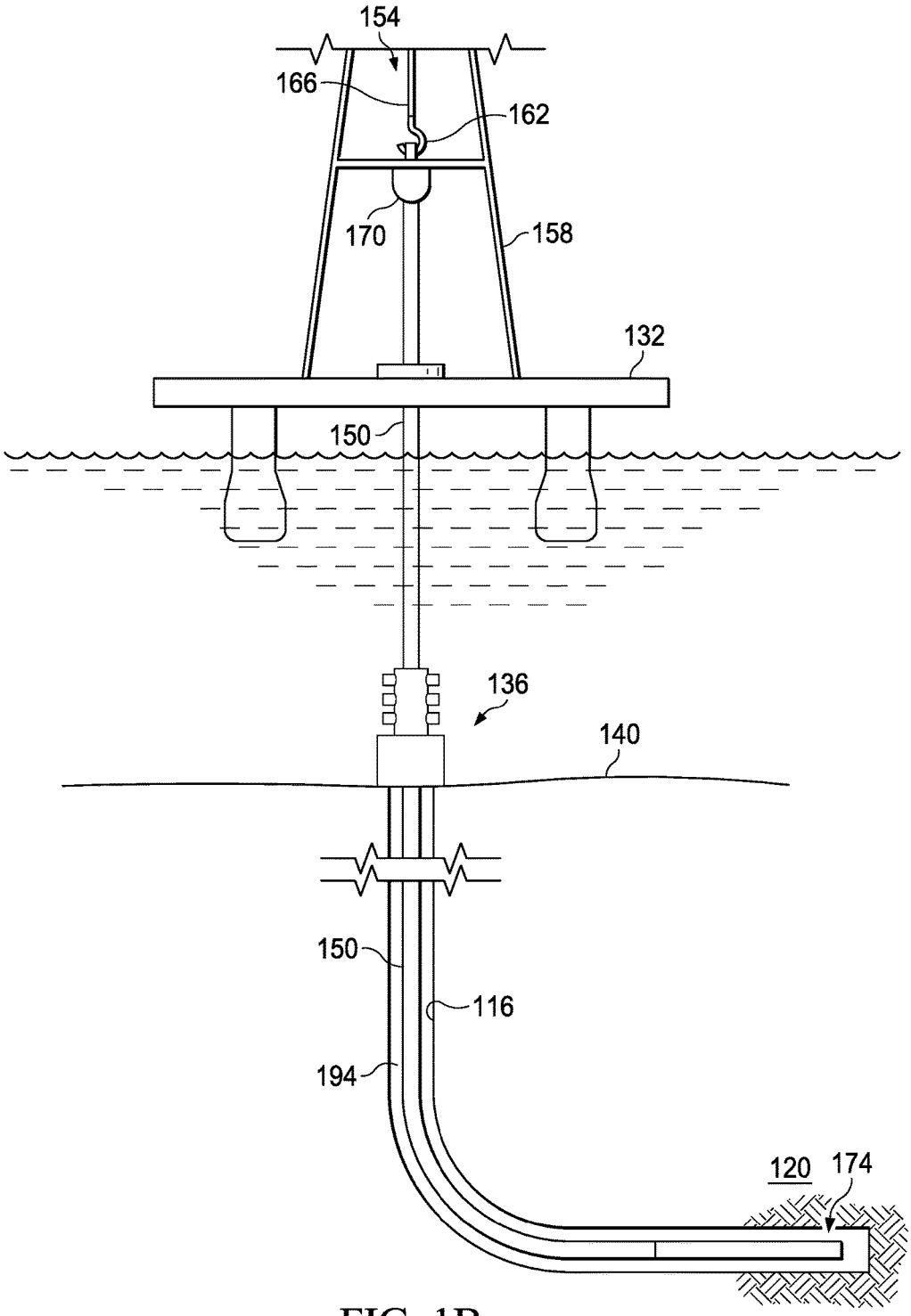
FIG. 1B illustrates a schematic view of an off-shore well having a completion system according to an illustrative embodiment.

FIG. 1A illustrates a schematic view of a rig 104 operating a completion system 100 according to an illustrative embodiment. Rig 104 is positioned at a surface 108 of a well 112. The well 112 includes a wellbore 116 that extends from the surface 108 of the well 112 to a subterranean substrate or formation 120. The well 112 and rig 104 are illustrated onshore in FIG. 1A. Alternatively, FIG. 1B illustrates a schematic view of an off-shore platform 132 operating the completion system 100 according to an illustrative embodiment. The completion system 100 in FIG. 1B may be deployed in a sub-sea well 136 accessed by the offshore platform 132. The offshore platform 132 may be a floating platform or may instead be anchored to a seabed 140.

FIGS. 1A-1B each illustrate possible uses or deployments of the completion system 100, and while the following description of the system 100 primarily focusses on the use of the completion system 100 during the completion and production stages, the system 100 also may be used in other stages of the well where it may be desired to set packers, or create or maintain multiples zones within the wellbore.

In the embodiments illustrated in FIGS. 1A and 1B, the wellbore 116 has been formed by a drilling process in which dirt, rock and other subterranean material is removed to create the wellbore 116. During or after the drilling process, a portion of the wellbore may be cased with a casing (not illustrated in FIGS. 1A and 1B). In other embodiments, the wellbore may be maintained in an open-hole configuration without casing. The embodiments described herein are applicable to either cased or open-hole configurations of the wellbore 116, or a combination of cased and open-hole configurations in a particular wellbore.

After drilling of the wellbore is complete and the associated drill bit and drill string are "tripped" from the wellbore 116, a work string 150 which may eventually function as a production string is lowered into the wellbore 116. The work string 150 may include sections of tubing, each of which are joined to adjacent tubing by threaded or other connection types. The work string may refer to the collection of pipes or tubes as a single component, or alternatively to the individual pipes or tubes that comprise the string. The term work string (or tubing string or production string) is not meant to be limiting in nature and may refer to any component or components that are capable of being coupled to the completion system 100 to lower or raise the completion system 100 in the wellbore 116 or to provide energy to the completion system 100 such as that provided by fluids, electrical power or signals, or mechanical motion. Mechanical motion may involve rotationally or axially manipulating portions of the work string 150. In some embodiments, the work string 150 may include a passage disposed longitudinally in the work string 150 that is capable of allowing fluid communication between the surface 108 of the well 112 and a downhole location 174.

The lowering of the work string 150 may be accomplished by a lift assembly 154 associated with a derrick 158 positioned on or adjacent to the rig 104 or offshore platform 132. The lift assembly 154 may include a hook 162, a cable 166, a traveling block (not shown), and a hoist (not shown) that cooperatively work together to lift or lower a swivel 170 that is coupled an upper end of the work string 150. The work string 150 may be raised or lowered as needed to add additional sections of tubing to the work string 150 to position the completion system 100 at the downhole location 174 in the wellbore 116.

A reservoir 178 may be positioned at the surface 108 to hold a fluid 182 for delivery to the well 112 during setting of the completion system 100. A supply line 186 is fluidly coupled between the reservoir 178 and the passage of the work string 150. A pump 190 drives the fluid 182 through the supply line 186 and the work string 150 toward the downhole location 174. As described in more detail below, the fluid 182 may also be used to carry out debris from the wellbore prior to or during the completion process. Still other uses of the fluid 182 may entail delivery of gravel or a proppant in a slurry to the downhole location 174 so that the well 112 may be gravel packed. After traveling downhole, the fluid 182 or portions thereof returns to the surface 108 by way of an annulus 194 between the work string 150 and the wellbore 116. At the surface 108, the fluid may be returned to the reservoir 178 through a return line 198. The fluid 178 may be filtered or otherwise processed prior to recirculation through the well 112.

Figure 2:
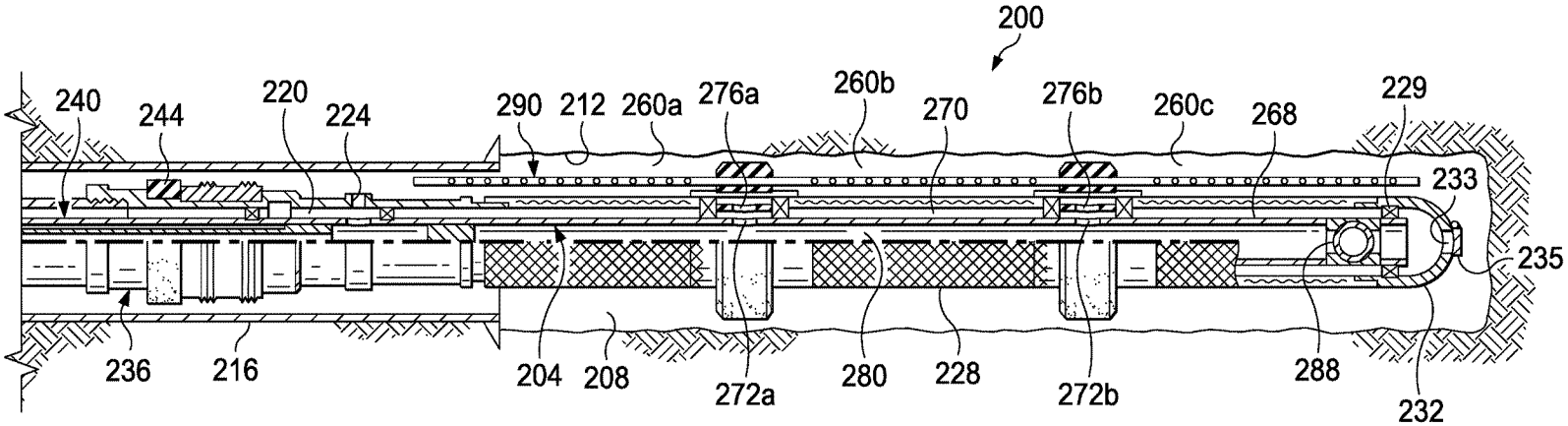
FIG. 2 illustrates a schematic and partially cut-away view of the completion system according to an illustrative embodiment, the completion system including a wash pipe positioned in a first position.
Figure 3:
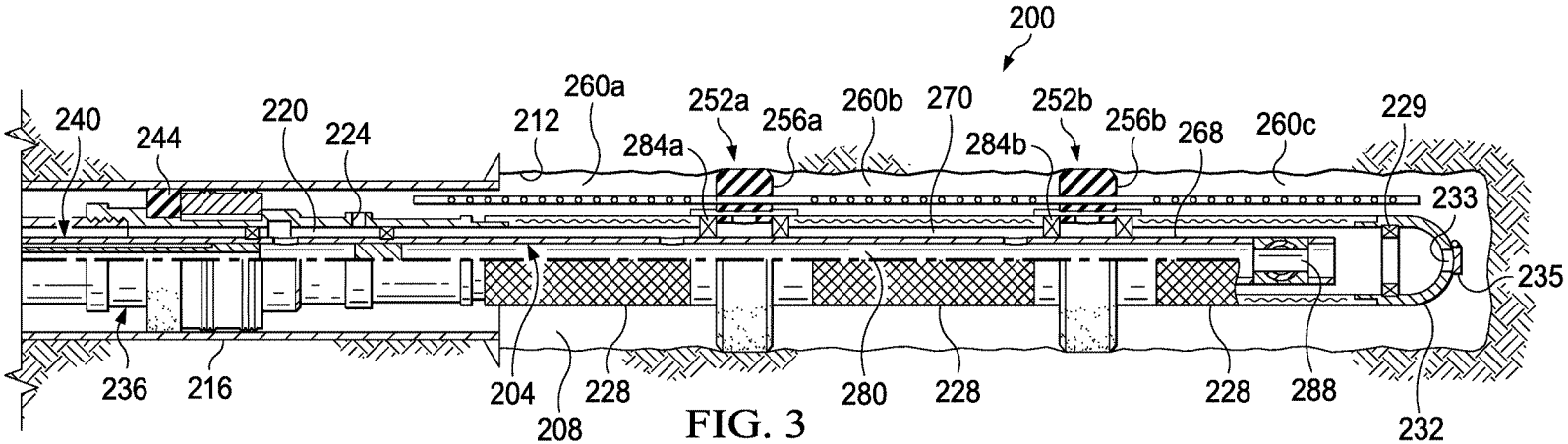
FIG. 3 illustrates a schematic and partially cut-away view of the completion system of FIG. 2 with the wash pipe positioned in a second position.
Figure 4:
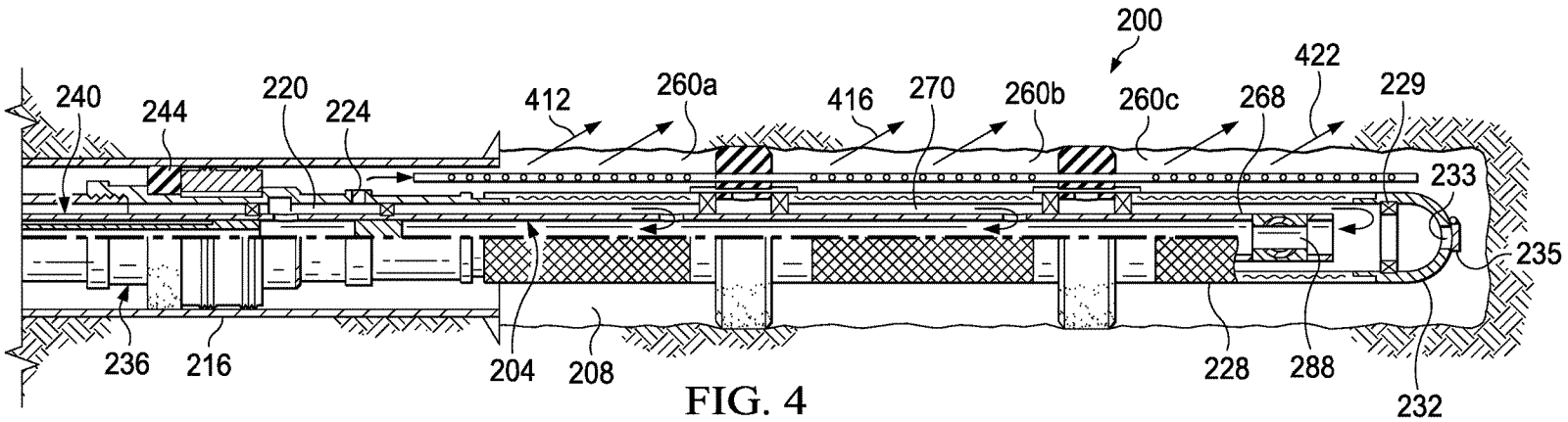
FIG. 4 illustrates a schematic and partially cut-away view of the completion system of FIG. 2 during gravel packing operations.

FIGS. 2-4 illustrate schematic and partially cut-away views of a system 200 according to an illustrative embodiment. The system 200 is similar to the completion system 100 referenced in FIGS. 1A and 2A and may be coupled to a work string similar to work string 150. In one embodiment, the system 200 includes a completion assembly 204 positioned in the wellbore such that an annulus 208 is created between the completion assembly 204 and a portion of a wellbore 212. In the embodiment illustrated in FIGS. 2-4, the wellbore 212 is partially cased with casing 216 and partially open-hole or uncased. Such an open-hole configuration often occurs below (or downhole) of any cased portion of the wellbore. The system 200 disclosed herein is particularly well suited to open-hole wellbore configurations, especially those in which the open-hole portion of the wellbore extends through a formation or substrate that is susceptible to partial or full collapse. However, the system 200 may also be used in cased wellbores, or any combination of cased and open-hole configurations.

In some embodiments, the completion assembly 204 may have a generally circular cross-sectional shape and include an inner passage 220 running longitudinally the length of the completion assembly 204. For example in these embodiments, the completion assembly 204 may include a base pipe or a series of coupled base pipes that are perforated to allow fluid communication between the annulus 208 and the inner passage 220. In other embodiments, the cross-sectional shape of the completion assembly 204 may be non-circular. The completion assembly 204 may include at least one exit port 224, the opening and closing of which is selectively controlled by a slidable or movable sleeve (not shown). The exit port 224 when opened permits fluid communication between the work string 150 and the annulus 208 by way of a crossover 226.

Positioned downhole from the exit port 224, the completion assembly 204 may further include at least one screen or slotted liner assembly 228. In some embodiments, the screen assembly 228 may comprise wire wrapped concentrically or helically around the perforated base pipe or a mesh media around the perforated base pipe such that a space between adjacent wrappings of the wire or mesh media is of a distance that allows control of particle sizes allowed to pass through the screen assembly 228. The at least one screen assembly 228 permits the passage of fluid (liquids or gases) between the annulus 208 and the inner passage 220 but prevents the passage of solids that are greater than a selected size associated with the screen assembly 228. More particularly, the screen assembly 228 is configured to prevent the passage of gravel or proppant contained in a gravel slurry from passing through slots, ports, apertures, or holes in the screen assembly 228 when the slots, ports, apertures, or holes are smaller in size than the size of the gravel particles. In some embodiments, the at least one screen assembly 228 includes a plurality of screen assemblies positioned in spaced relationship along the completion assembly 204. Regardless of whether a single or multiple screen assemblies 228 are used, each screen assembly 228 in some embodiments extends circumferentially around the completion assembly 204 such that the paths of fluid communication provided by the screen assembly are maximized. In other embodiments, the screen assemblies 228 may extend only partially around the completion assembly 204, thereby providing a more limited path of fluid communication relative to those screen assemblies 228 that circumferentially surround the completion assembly 204.

In some embodiments, the completion assembly 204 may have a float shoe 232 coupled to an end of the completion assembly 204. The float shoe 232 in the embodiment illustrated in FIG. 2 includes at least one aperture 233 that is positioned centrally on the float shoe 232 relative to a longitudinal axis of the completion assembly 204. Other locations for the aperture 233 are also possible, and aperture 233 in some embodiments may have at least one check valve 235 coupled to or otherwise associated with the aperture 233 to allow fluid flow through the aperture 233 in only one direction. The check valve 235 may be any suitable valve to suit this purpose, including without limitation a poppet valve or a flapper valve. The check valve 235 permits fluid flow through the aperture 233 from the inner passage 220 of the completion assembly 204 to the annulus 208. The check valve 235 prevents fluid flow through the aperture 233 from the annulus 208 to the inner passage 220.

The system 200 includes a gravel pack packer 236 or liner hanger associated with the completion assembly 204 or alternatively with a service tool 240. More specifically, the gravel pack packer 236 is positioned uphole of each of the screen assemblies 228 and may be coupled to either the completion assembly 204, the service tool 240, or both. The gravel pack packer 236 is positionable in a set position or an unset position. In the unset position (see FIG. 2), which is a non-sealing position, the gravel pack packer 236 is capable of being run into the wellbore 212. In the set position (see FIGS. 3 and 4), the gravel pack packer 236 is configured to provide a barrier or seal in the annulus 208 between the completion assembly 204 and a portion of the wellbore 212 (either cased or uncased). The gravel pack packer 236 includes at least one sealing element 244 that is configured to be retracted in the unset position and expanded in the set position. In some embodiments, the sealing element 244 of the gravel pack packer 236 is activated by applying pressure from the surface to a wellbore fluid. The gravel pack packer 236 may instead by actuated in other ways, including without limitation hydrostatic pressure, use of a hydraulic setting tool and pressure applied from the surface, dropping a ball in the hydraulic setting tool, electrically, downhole hydraulic pressure generation triggered by a signal from the surface, or any combination of these or other methods.

The system 200 further includes at least one packer 252 associated with the completion assembly 204. In the embodiment illustrated in FIGS. 2-4, the at least one packer 252 is an isolation packer and may include a plurality of packers. More specifically, in this embodiment, a first packer 252*a* and a second packer 252*b* are provided. In the embodiment illustrated in FIGS. 2-4, each of the first packer 252*a* and the second packer 252*b* is positioned between a pair of screen assemblies 228, and each is positioned downhole of the gravel pack packer 236. In other embodiments, it may be desirable to not include the screen assembly 228 in a zone that is not to be gravel packed. The first packer 252*a* and the second packer 252*b* are each positionable independently in a set position or an unset position. In the unset position (see FIG. 2), which is a non-sealing position, the first packer 252*a* and the second packer 252*b* are capable of being run into the wellbore 212. In the set position (see FIGS. 3 and 4), the first packer 252*a* and the second packer 252*b* are each configured to provide a barrier or seal in the annulus 208 between the completion assembly 204 and a portion of the wellbore 212 (either cased or uncased). Each of the first packer 252*a* and the second packer 252*b* includes at least one sealing element 256*a*, 256*b* that is configured to be retracted in the unset position and expanded in the set position. In some embodiments, the sealing elements 256*a*, 256*b* may be activated or expanded by increasing a pressure of fluid exposed to the first packer 252*a* and the second packer 252*b*. This pressure increase may be the result of a pressure applied at the surface of the well, or may be a downhole-generated pressure that is applied after receiving a signal from the surface. In these embodiments, the first packer 252*a* and the second packer 252*b* are hydraulic packers. Alternatively, the first packer 252*a* and the second packer 252*b* may be hydrostatic packers or swellable packers. In other embodiments, the first packer 252*a* and the second packer 252*b* may be remotely activated upon receiving a pressure or acoustical signal.

When positioned in the set position, the gravel pack packer 236 and the first packer 252*a* define a first zone 260*a* in the annulus 208 between the gravel pack packer 236 and the first packer 252*a*. Similarly, when the first packer 252*a* and the second packer 252*b* are set, a second zone 260*b* is defined in the annulus 208 between the first packer 252*a* and the second packer 252*b*. In the embodiment illustrated in FIGS. 2-4, a third zone 260*c* is defined in the annulus 208 downhole of the second packer 252*b* when the second packer 252*b* is positioned in the set position. While FIGS. 2-4 are illustrated with only three packers (gravel pack packer 236, first packer 252*a*, and second packer 252*b*), additional packers could be used with the system 200 depending on the number of zones that are desired. The distance between the packers may be substantially equal to produce similarly sized zones, or in some cases, it may be desirable to vary the spacing of the packers and thus the size of the zones. The zones may in some instances be production zones, or may instead simply be isolation zones that are not necessarily involved in production.

The system 200 further may include a wash pipe 268 positioned within the inner passage 220 of the completion assembly 204 such that the wash pipe 268 is axially movable relative to the completion assembly 204. An annulus 270 is defined between the wash pipe 268 and the completion assembly 204. In some embodiments, the wash pipe 268 is coupled to the service tool 240 such that the wash pipe 268 is capable of being positioned downhole as the service tool 240 and gravel pack packer 236 are run into the wellbore 212. The wash pipe 268 includes at least one port and preferably a port for each packer associated with the system 200 other than the gravel pack packer 236. More specifically, in the embodiment illustrated in FIGS. 2-4, the wash pipe includes a port 272*a* associated with the first packer 252*a* and a second port 272*b* associated with the second packer 252*b*. Each of the ports 272*a*, 272*b* permits fluid communication through the wash pipe 268.

The wash pipe 268 is positionable in a first position (see FIG. 2) in which port 272*a* is aligned with a port 276*a* on the first packer 252*a* to allow fluid communication between an inner passage 280 of the wash pipe 268 and the port 276*a*. Similarly, in the first position port 272*b* is aligned with a port 276*b* on the second packer 252*b* to allow fluid communication between the inner passage 280 of the wash pipe 268 and the port 276*b*. The fluid communication between the inner passage 280 and each of the first and second packers 252*a*, 252*b* allows fluid to be delivered to the packers 252*a*, 252*b* to expand the sealing elements 256*a*, 256*b* and thus set the packers 252*a*, 252*b*. The ability to set the packers is dependent on being able to close the end of the wash pipe 268 such that pressure may be accumulated within the wash pipe 268. This capability is provided by a valve that is described in more detail below.

Seals 284*a*, 284*b* or seal bores are coupled to the packers 252*a*, 252*b* and slick joints or seals are coupled to the wash pipe 268 to seal around the ports 272*a*, 272*b* when the wash pipe 268 is in the first position. In this position, each of the seals 284*a*, 284*b* isolate a portion of the annulus 270 between ports 272*a*, 272*b* and ports 276*a*, 276*b*, respectively. The seals 284*a*, 284*b* ensure that fluid from the wash pipe 268 when the wash pipe 268 is in the first position is limited to communication with the packers 252*a*, 252*b* and is not dispersed throughout the annulus 270.

The wash pipe 268 is positionable in a second position in which each of ports 272*a*, 272*b* is approximately aligned with a different screen assembly 228 and any perforations in the base pipe or completion assembly 204. In this position, the port 272*a* is approximately aligned with the screen assembly 228 between gravel pack packer 236 and first packer 252*a*. The port 272*a* in this alignment allows fluid communication between inner passage 280 and first zone 260*a*. The port 272*b* is approximately aligned with the screen assembly 228 between first packer 252*a* and second packer 252*b*. The port 272*b* in this alignment allows fluid communication between inner passage 280 and second zone 260*b*. The wash pipe 268 in the second position allows more direct fluid communication between a particular zone and the inner passage 280 of the wash pipe 268. This effectively shortens or minimizes the equivalent circulating density required to circulate fluid from the surface through the zone and then back to the surface. This shortened circulation path (compared to circulating fluid to an end of the wellbore where it could enter the wash pipe 268) prevents excessive pressure drops, which allows lower pressures to be used to gravel pack the individual zones.

It is important to note that while each zone illustrated in FIGS. 2-4 includes a screen assembly 228, it is not required that each zone include a screen assembly. In some embodiments, one or more of the zones may be non-producing zones and a screen assembly 228 may not be required or desired in these particular zones.

As shown in FIGS. 2-4, an end of the wash pipe 268 may terminate within or proximate to the float shoe 232. One or more seals 229 may be coupled to the float shoe 232 or the wash pipe 268 to seal between the float shoe 232 and the wash pipe 268.

The system 200 further includes a flow control device 288 operably associated with either the wash pipe 268, the float shoe 232 or the completion assembly 204 to selectively allow or prevent fluid communication between an inner passage 280 of the wash pipe 268 and the annulus 208. In the embodiment illustrated in FIGS. 2-5, the flow control device 288 is a valve positioned within or coupled to the end of the wash pipe 268. The flow control device 288 may in some embodiments be a flow control device 288 that is remotely actuated from a surface of the well by changing the pressure of a fluid that communicates with the flow control device 288. In one example, the change in fluid pressure is capable of actuating a ball device associated with the flow control device 288 that opens or closes a fluid path through the flow control device 288. One example of a flow control device that may be used with system 200 is the e-Red valve sold by Halliburton Energy Services under part numbers 796971, 831614, 796956, or 796962. Flow control device 288 may be any type of valve or other device that is capable of remote actuation and the ability to selectively permit or prevent fluid communication. Multiple methods of activating the flow control device are possible, including activation in response to pressure, time, temperature, acoustic pulses, or other triggering stimuli.

When the flow control device 288 is coupled to or positioned within the wash pipe 268 as illustrated in FIG. 2, the opening or closing of the flow control device 288 may be used in conjunction with axial movement of the wash pipe 268 to control fluid into or out of the annulus 208. For example, when the flow control device 288 is in a closed position and the wash pipe 268 is positioned in the first position (see FIG. 2), no fluid is allowed into or out of the float shoe 232, and no fluid is permitted to exit the end of the wash pipe 268. Contrast this with the wash pipe 268 being in the first position and the flow control device 288 being placed in an open position. This configuration would allow fluid delivered through the wash pipe 268 to exit the aperture 233 such as would be the case if wash down was performed while running the completion assembly 204 to final depth. When the wash pipe 268 is positioned in the second position and the flow control device 288 is positioned in the open position (see FIGS. 3 and 4), fluid communication is allowed between the annulus 208 and the inner passage 280 of the wash pipe 268 through the end of the wash pipe 268. It is important to note that the fluid flowing from the annulus 208 does not enter the float shoe 232 through the aperture 233 due to the presence of the check valve 235. Instead the fluid enters the annulus 270 through the screen assembly 228 nearest the third zone 260*c* and travels around and into the end of the wash pipe 268. This pathway is permitted since the wash pipe 268 is in the second position and no longer sealingly engaged to the float shoe 232.

The system 200 further includes a gravel delivery tube 290 positioned external to the completion assembly 204. The gravel delivery tube 290 is a conduit or a series of conduits that allow gravel delivery into each of the defined zones. The gravel delivery tube 290, whether a single tube or multiple tubes, is coupled to the packers or passages associated with the packers such that the gravel delivery tube 290 is capable of providing fluid communication across zones even when the packers are in the set position. The gravel delivery tube 290 allows fluid communication between zones that are established when the packers are set. This fluid communication provides pressure equalization, or at least reduction of pressure differentials, between the zones. This communication is important as it permits maintenance of hydrostatic pressure within each zone to reduce the likelihood of wellbore collapse. Because of the presence of the seals 284*a*, 284*b* in the annulus 270 preventing fluid communication between zones when the wash pipe 268 is in the first position, the fluid communication provided between zones by the gravel delivery tube 290 may in some circumstances be the only path through which pressure equalization is provided.

Figure 5:
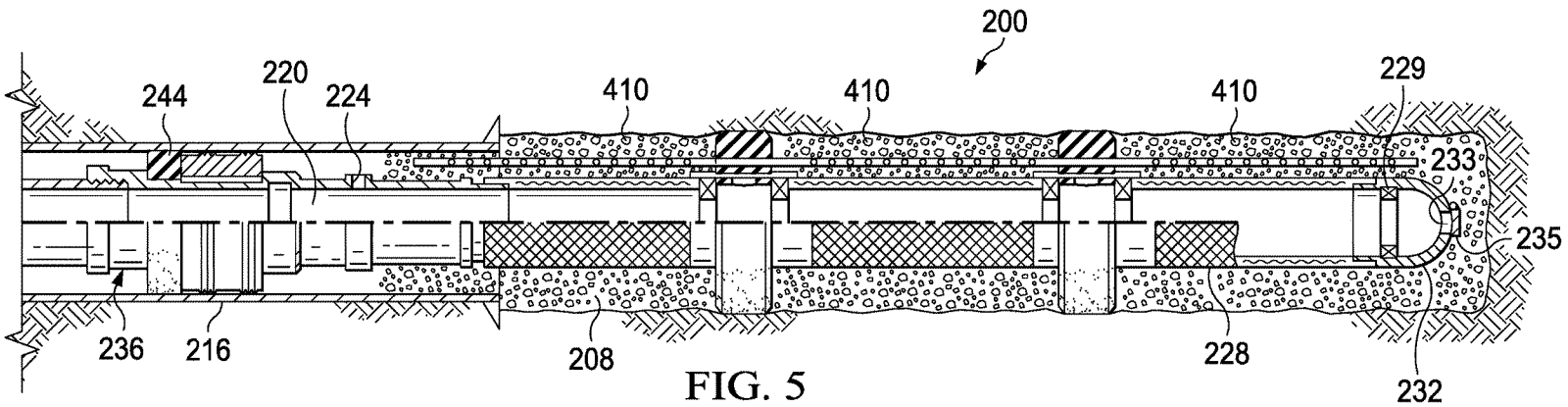

FIG. 5 illustrates a schematic and partially cut-away view of the system 200 following delivery of gravel 410 to the various zones and following removal of the service tool and wash pipe 268. Following gravel pack operations, the system 200 is configured to allow production of oil and gas from the formation through the gravel 410, screen assemblies 228, and through the work string 150 or tubing to the surface of the well.

Figure 6:
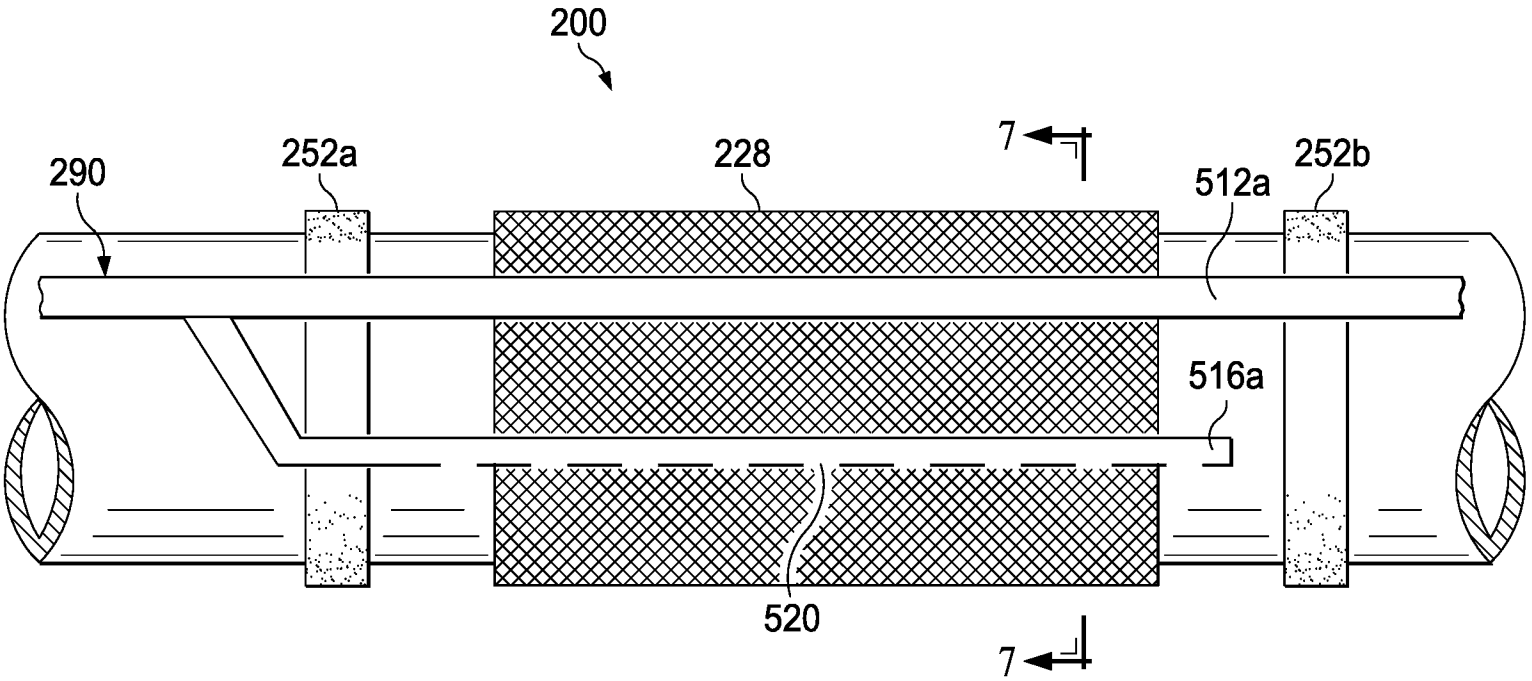
FIG. 6 illustrates an enlarged schematic view of the portion of the completion system of FIG. 2, the completion system in one embodiment having a gravel delivery system that includes at least one transport tube and at least one packing tube.

FIG. 6 illustrates an enlarged schematic view of a portion of the completion system 200 of FIG. 2. As previously mentioned, the completion system 200 includes first packer 252*a* and second packer 252*b* positioned on or otherwise associated with completion assembly 204. Screen assembly 228 is provided between the first and second packers 252*a*, 252*b*. The gravel delivery tube 290 previously described with reference to FIGS. 2-4 is illustrated both in FIG. 6 and the cross-sectional view of FIG. 7A as including a pair of transport tubes 512*a*, 512*b* and a pair of packing tubes 516*a*, 516*b*. Each of the packing tubes 516*a*, 516*b* includes one or more orifices or ports 520 to permit delivery of a gravel slurry to the zone formed between first packer 252*a* and second packer 252*b*.

Figure 7A:
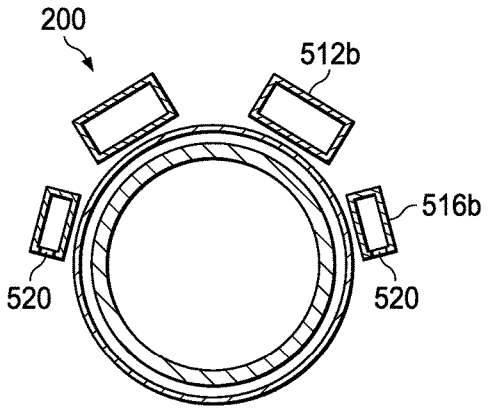
FIG. 7A illustrates a cross-sectional view of the completion system of FIG. 6 taken at 7-7.
Figure 7B:
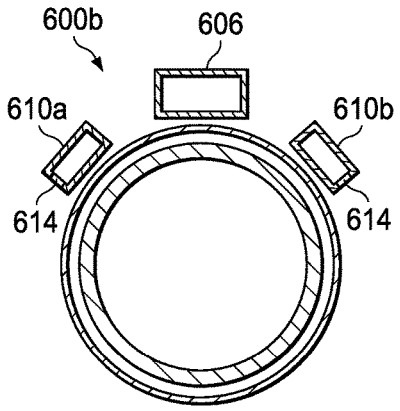
FIG. 7B illustrates a cross-sectional view of a completion system similar to that of FIG. 6 taken at 7-7, the completion system in the illustrated embodiment having a gravel delivery system that includes a transport tube and a pair of packing tubes.

FIG. 7B illustrates a cross-sectional view of a completion system 600*b* similar to that illustrated in FIGS. 6 and 7A, yet a gravel delivery tube includes a single transport tube 606 and a pair of packing tubes 610*a*, 610*b*. Each of the packing tubes 610*a*, 610*b* is fluidly connected to the single transport tube 606 such that gravel slurry delivered through the transport tube 606 flows into the packing tubes 610*a*, 610*b*. Orifices or ports 614 are provided on the packing tubes 610*a*, 610*b* to allow release of the gravel slurry from the packing tubes 610*a*, 610*b* into the applicable zone.

Figure 7C:
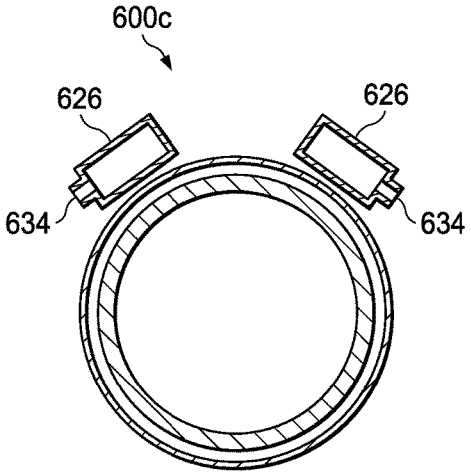
FIG. 7C illustrates a cross-sectional view of a completion system similar to that of FIG. 6 taken at 7-7, the completion system in the illustrated embodiment having a gravel delivery system that includes a pair of transport tubes.

FIG. 7C illustrates a cross-sectional view of a completion system 600*c* similar to that illustrated in FIGS. 6 and 7A, yet a gravel delivery tube includes a pair of transport tubes 626 only. Each of the transport tubes 626 includes orifices or ports 634 to allow release of the gravel slurry from the transport tubes 626 into the applicable zone. In the embodiment illustrated in FIG. 7C, the transport tubes 626 are positioned at approximately 10 and 2 o'clock, and the orifices or ports 634 for each transport tube 626 generally faces away from the orifices or ports 634 for the other transport tube 626.

Figure 7D:
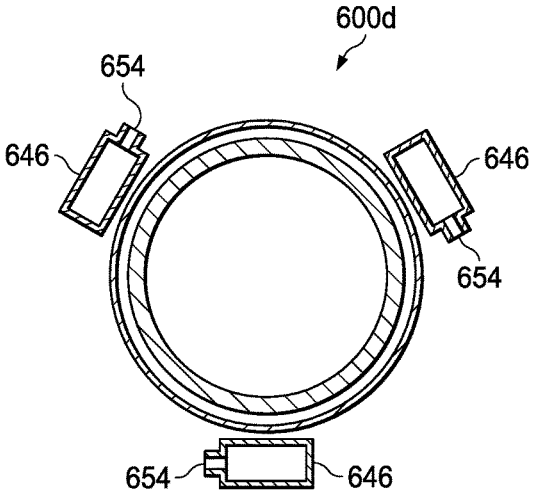
FIG. 7D illustrates a cross-sectional view of a completion system similar to that of FIG. 6 taken at 7-7, the completion system in the illustrated embodiment having a gravel delivery system that includes at least three transport tubes.

FIG. 7D illustrates a cross-sectional view of a completion system 600*d* similar to that illustrated in FIGS. 6 and 7A, yet a gravel delivery tube includes three transport tubes 646. Each of the transport tubes 646 includes orifices or ports 654 to allow release of the gravel slurry from the transport tubes 646 into the applicable zone. In the embodiment illustrated in FIG. 7D, the transport tubes 646 are positioned at approximately 10, 2, and 6 o'clock, and the orifices or ports 654 for each transport tube 646 generally is oriented on the same side as that of the other ports 654 and transport tubes 646.

In operation, and referring again to FIGS. 2-5, the completion system 200 may be run into the wellbore to final depth as illustrated in FIG. 2. During run-in, the flow control device 288 may be open to allow wash down as the completion passes through cased and particularly open-hole portions of the wellbore. Wash down is provided by delivering fluid through the wash pipe 268 when the flow control device 288 is open such that the fluid exits the end of the wash pipe 268 travels through the check valve 235 and aperture 233 of the float shoe. The fluid clears any debris or other material from the wellbore. After the completion system is delivered to depth, the gravel pack packer 236 is set in one of the ways previously described, and the flow control device 288 is closed.

Following the running and setting of the gravel pack packer 236 in the wellbore, the first and second packers 252*a*, 252*b* are set by positioning the wash pipe 268 in the first position as illustrated in FIG. 2 and closing the flow control device 288. In this configuration, fluid pressure at the first packer 252*a* may be increased via the wash pipe 268 and the port 272*a* to activate the expandable element of the first packer 252*a*. Similarly, fluid pressure at the second packer 252*b* may be increased via the wash pipe 268 and the port 272*b* to activate the expandable element of the second packer 252*b*. The increase in pressure at each packer may be provided by increasing the pressure of fluids at the surface of the well, or by other means described herein. Since the flow control device 288 remains closed during this portion of the operation, the wash pipe 268 is capable of remaining pressurized during this operation.

After the first and second packers 252*a*, 252*b* are set, the wash pipe 268 may be moved to the second position as illustrated in FIG. 3 and the flow control device 288 opened. In this configuration the ports 272*a*, 272*b* are aligned with and fluidly communicate with the first zone 260*a* and the second zone 260*b*, respectively. Referring more specifically to FIG. 4, gravel packing is commenced by delivering a gravel or proppant containing slurry from the surface of the well through the work string 150 (see FIGS. 1A and 1B). As the slurry enters the completion assembly 204, the slurry passes through the exit port 224 and into the annulus 208 of the first zone 260*a* as indicated by arrows 412. As the slurry moves into the first zone 260*a*, gravel or proppant that is too large to pass through the screen assembly 228 begins to collect and pack within the first zone 260*a*. Fluid from the slurry passes through the screen assembly 228, and this "clean" fluid travels through the port 272*a* and into the wash pipe 268. Seals 284*a* prevent the fluid from traveling down the annulus 270. Instead, the clean fluid is returned to the surface via the annulus 208 after passing from the wash pipe 268 into the annulus 208 by way of the crossover 226.

The first zone 260*a* continues to fill with gravel or proppant, and as the first zone 260*a* becomes fully packed, the gravel slurry encounters more resistance to flow within the first zone 260 which results in the slurry entering the gravel delivery 290. The gravel delivery tube 290, which provided pressure equalization during the setting of the packers 252*a*, 252*b*, now provides a pathway for delivery of the gravel slurry to the second zone 260*b*. The second zone 260*b* fills in a manner similar to that described for the first zone 260*a*, as indicated by arrows 416. When the second zone 260*b* is fully packed, the third zone 260*c* is similarly packed, yet in the packing of this zone, the passage of clean fluid through the screen assembly 228 and into the wash pipe 268 may be through the flow control device 288 instead of a port in the wash pipe 268. It should be understood, however, that in some embodiments a port in the wash pipe similar to port 272*a*, 272*b* may be provided in fluid communication with the third zone 260*c*. Gravel packing in the third zone 260*c*, as indicated by arrows 422 continues until the third zone 260*c* is completely packed.

Referring to FIG. 5, following completion of gravel packing, the service tool and wash pipe 268 are removed from the well. Production is allowed to proceed through at least one of the three zones 260*a*, 260*b*, and 260*c*. Oil and gas produced by the formation pass through the gravel 410 in the applicable zone and into the completion assembly 204 through the screen assembly 288. The production fluids flow through the completion assembly 204 and into the work string 150 or tubing to be delivered to the surface 108 of the well 112.

During gravel packing and completion operations, it is important to minimize the chances of partial or total wellbore collapse. The present disclosure describes systems and methods that allow completion and gravel packing of multiple zones while providing more reliable methods of setting packers and establishing those zones. Pressure equalization is maintained across the zones as the packers are set to minimize the risks of collapse. In addition to the embodiments described above, many examples of specific combinations are within the scope of the disclosure, some of which are detailed below.

In a first example, a system for use in a wellbore includes a completion assembly extending into the wellbore such that a first annulus is created between the completion assembly and a portion of the wellbore. A gravel pack packer is adapted to seal between the completion assembly and a first, cased portion of the wellbore. At least one isolation packer is positioned downhole of the gravel pack packer. The at least one isolation packer is adapted to seal between the completion assembly and a second, cased or uncased portion of the wellbore. The gravel pack packer and the at least one isolation packer when set create at least one zone in the first annulus between the gravel pack packer and the isolation packer. The system further includes a wash pipe positioned within the completion assembly such that a second annulus is defined between the wash pipe and the completion assembly. The wash pipe includes at least one port to allow fluid communication between an interior passage of the wash pipe and the second annulus.

In the first example, the system may further include a valve that is operably associated with the wash pipe to allow or prevent fluid communication between the interior passage and the first annulus. The system may also include a gravel delivery tube positioned external to the completion assembly, the gravel delivery tube allowing gravel delivery to the zone. The system may also be configured such that the at least one isolation packer includes two or more isolation packers, each isolation packer cooperating with the gravel pack packer or another of the isolation packers to define one of the zones in the first annulus. The system may also be configured such that the at least one port of the wash pipe includes a plurality of ports and each port is associated with a different of the zones. The system may be configured such that the wash pipe is positionable in a first position to allow fluid communication between each of the plurality of ports and a corresponding packer of the plurality of packers, the wash pipe positionable in a second position to allow fluid communication each of the plurality of ports and a corresponding zone of the zones. The system may be configured such that fluid communication between each of the plurality of ports and the corresponding packer of the plurality of packers further includes fluid communication between each of the plurality of ports and a corresponding hydraulic port on each corresponding packer to deliver fluid to the corresponding packer such that a sealing element of the corresponding packer is set. The system may be configured such that the valve is remotely activated. Each of the preceding configurations and elements of the system of the first example optionally may be utilized with the system, and the various configurations and elements may be combined with other described configurations and elements in any particular combination.

In a second example, a system for use in a wellbore includes a completion assembly having a gravel pack packer. The completion assembly is positioned in the wellbore such that an annulus is created between the completion assembly and a portion of the wellbore. A first packer is associated with the completion assembly and is positioned downhole of the gravel pack packer. The gravel pack packer and the first packer define a first zone in the annulus between the gravel pack packer and the first packer. The system includes a second packer associated with the completion assembly and positioned downhole of the first packer, the first packer and the second packer defining a second zone in the annulus between the first packer and the second packer. A wash pipe is positioned within the completion assembly and includes at least two ports. The wash pipe is positionable in a first position to allow fluid communication between the first port and the first packer and the second port and the second packer. The wash pipe is positionable in a second position to allow fluid communication between the first port and the first zone and the second port and the second zone. The system further includes a gravel delivery tube positioned external to the completion assembly, the gravel delivery tube allowing gravel delivery into at least one of the first zone and the second zone.

In the second example, the system may be configured such that the wash pipe in the second position allows pressure equalization between the first zone and the second zone. The system may be configured such that the first packer and the second packer are hydraulic packers. The system may be configured such that fluid communication between the first port and the first packer further comprises fluid communication between the first port and a hydraulic port of the first packer to deliver fluid to the first packer such that a sealing element of the first packer is set. The system may be configured such that fluid communication between the first port and the first packer further comprises fluid communication between the first port and a hydraulic port of the first packer to deliver fluid to the first packer such that a sealing element of the first packer is set. The system may further include a valve operably associated with the wash pipe or the completion assembly to allow or prevent fluid communication between an interior passage of the wash pipe and the annulus. The system may be configured such that a portion of the completion assembly in each of the first zone and the second zone includes a port to allow fluid communication between an interior of the completion assembly and the annulus. The system may further include a screen assembly to prevent gravel of a selected size in each zone from entering the interior of the completion assembly. Each of the preceding configurations and elements of the system of the second example optionally may be utilized with the system, and the various configurations and elements may be combined with other described configurations and elements in any particular combination.

In a third example, a method of gravel packing a wellbore includes establishing at least two zones in the wellbore, flowing a gravel slurry to at least one of the zones to gravel pack the at least one zone, and reducing an equivalent circulation density of fluid from the gravel slurry returning to a surface of the wellbore.

In the third example, the method may further include providing fluid communication between the at least two zones to reduce a pressure differential between the at least two zones. The method may be configured such that establishing at least two zones further includes setting a plurality of packers to seal between a completion assembly and a portion of the wellbore. The method may be configured such that each of the at least two zones is defined between two of the plurality of packers in an annulus between the completion assembly and the portion of the wellbore. The method may further include providing a wash pipe within the completion assembly, wherein establishing at least two zones further comprises flowing fluid through the wash pipe to hydraulically set the plurality of packers. The method may be configured such that flowing a gravel slurry to at least one of the zones further includes flowing the gravel slurry to a first of the at least two zones and following gravel packing of the first, flowing the gravel slurry to a second of the at least two zones. The method may be configured such that providing fluid communication between the at least two zones further includes screening the flow of fluid between the at least two zones to prevent gravel in the gravel slurry from moving between the at least two zones. The method may further include providing a wash pipe within the completion assembly, wherein providing fluid communication between the at least two zones further includes aligning ports in the wash pipe with the at least two zones such that fluid communication between the at least two zones is provided through the wash pipe. Each of the preceding configurations and elements of the method of the third example optionally may be utilized with the method, and the various configurations and elements may be combined with other described configurations and elements in any particular combination.

It should be apparent from the foregoing that embodiments of an invention having significant advantages have been provided. While the embodiments are shown in only a few forms, the embodiments are not limited but are susceptible to various changes and modifications without departing from the spirit thereof.

We claim:

1. A system for use in a wellbore, the system comprising:

a completion assembly extending into the wellbore such that a first annulus is created between the completion assembly and a portion of the wellbore;

a gravel pack packer adapted to seal between the completion assembly and a first, cased portion of the wellbore;

at least one isolation packer positioned downhole of the gravel pack packer, the at least one isolation packer adapted to seal between the completion assembly and a second, cased or uncased portion of the wellbore, the gravel pack packer and the at least one isolation packer when set creating at least one zone in the first annulus between the gravel pack packer and the isolation packer;

a wash pipe positioned within the completion assembly such that a second annulus is defined between the wash pipe and the completion assembly, the wash pipe having at least one port to allow fluid communication between an interior passage of the wash pipe and the second annulus;

wherein the at least one isolation packer comprises two or more isolation packers, each isolation packer cooperating with the gravel pack packer or another of the isolation packers to define one of the zones in the first annulus: and wherein the at least one port of the wash pipe includes a plurality of ports and each port is associated with a different of the zones.

2. The system of claim 1 further comprising:

a valve operably associated with the wash pipe to allow or prevent fluid communication between the interior passage and the first annulus.

3. The system of claim 2, wherein the valve is remotely activated.

4. The system of claim 1 further comprising:

a gravel delivery tube positioned external to the completion assembly, the gravel delivery tube allowing gravel delivery to the zone.

5. The system of claim 1, wherein the wash pipe is positionable in a first position to allow fluid communication between each of the plurality of ports and a corresponding packer of the plurality of packers, wherein the wash pipe is positionable in a second position to allow fluid communication between each of the plurality of ports and a corresponding zone of the zones.

6. The system of claim 5, wherein:

fluid communication between each of the plurality of ports and the corresponding packer of the plurality of packers further comprises fluid communication between each of the plurality of ports and a corresponding hydraulic port on each corresponding packer to deliver fluid to the corresponding packer such that a sealing element of the corresponding packer is set.

7. A system for use in a wellbore comprising:

a completion assembly having a gravel pack packer, the completion assembly positioned in the wellbore such that an annulus is created between the completion assembly and a portion of the wellbore;

a first packer associated with the completion assembly and positioned downhole of the gravel pack packer, the gravel pack packer and the first packer defining a first zone in the annulus between the gravel pack packer and the first packer;

a second packer associated with the completion assembly and positioned downhole of the first packer, the first packer and the second packer defining a second zone in the annulus between the first packer and the second packer;

a wash pipe positioned within the completion assembly and having at least two ports, the wash pipe positionable in a first position to allow fluid communication between the first port and the first packer and the second port and the second packer, the wash pipe positionable in a second position to allow fluid communication between the first port and the first zone and the second port and the second zone; and a gravel delivery tube positioned external to the completion assembly, the gravel delivery tube allowing gravel delivery into at least one of the first zone and the second zone.

8. The system of claim 7, wherein the wash pipe in the second position allows pressure equalization between the first zone and the second zone.

9. The system of claim 7, wherein the first packer and the second packer are hydraulic packers.

10. The system of claim 9, wherein:

fluid communication between the first port and the first packer further comprises fluid communication between the first port and a hydraulic port of the first packer to deliver fluid to the first packer such that a sealing element of the first packer is set; and fluid communication between the first port and the first packer further comprises fluid communication between the first port and a hydraulic port of the first packer to deliver fluid to the first packer such that a sealing element of the first packer is set.

11. The system of claim 7 further comprising:

a valve operably associated with the wash pipe or the completion assembly to allow or prevent fluid communication between an interior passage of the wash pipe and the annulus.

12. The system of claim 7, wherein a portion of the completion assembly in each of the first zone and the second zone includes a port to allow fluid communication between an interior of the completion assembly and the annulus, the system further comprising:

a screen assembly to prevent gravel of a selected size in each zone from entering the interior of the completion assembly.

13. A method of gravel packing a wellbore, the method comprising:

providing a completion assembly extending into the wellbore such that a first annulus is created between the completion assembly and a portion of the wellbore;

establishing at least two zones in the first annulus in the wellbore;

flowing a gravel slurry through the completion assembly to a first of the at least two zones to gravel pack the first zone of the at least two zones;

then flowing the gravel slurry to a second of the at least two zones to gravel pack the second zone of the at least two zones, wherein the first zone of the at least two zones is uphole of the second zone of the at least two zones; and reducing an equivalent circulation density of fluid from the gravel slurry returning to a surface of the wellbore.

14. The method of claim 13 further comprising:

providing fluid communication between the at least two zones to reduce a pressure differential between the at least two zones.

15. The method of claim 13, wherein establishing at least two zones further comprises:

setting a plurality of packers to seal between a completion assembly and a portion of the wellbore.

16. The method of claim 15, wherein each of the at least two zones is defined between two of the plurality of packers in an annulus between the completion assembly and the portion of the wellbore.

17. The method of claim 15 further comprising:

providing a wash pipe within the completion assembly; and wherein establishing at least two zones further comprises flowing fluid through the wash pipe to hydraulically set the plurality of packers.

18. The method of claim 15 further comprising:

providing a wash pipe within the completion assembly; and wherein providing fluid communication between the at least two zones further comprises aligning ports in the wash pipe with the at least two zones such that fluid communication between the at least two zones is provided through the wash pipe.

19. The method of claim 13, wherein flowing a gravel slurry to at least one of the zones further comprises:

flowing the gravel slurry to a first of the at least two zones; and following gravel packing of the first of the at least two zones, flowing the gravel slurry to a second of the at least two zones.

20. The method of claim 13, wherein providing fluid communication between the at least two zones further comprises:

screening the flow of fluid between the at least two zones to prevent gravel in the gravel slurry from moving between the at least two zones.

* * * * *